United States Patent [19]

Dobosh

[11] 4,408,504

[45] Oct. 11, 1983

[54] SOCKET DRIVE

[76] Inventor: Raymond M. Dobosh, 5455 Brownsville Rd., Pittsburgh, Pa. 15236

[21] Appl. No.: 286,688

[22] Filed: Jul. 24, 1981

[51] Int. Cl.[3] ..... B25B 13/00

[52] U.S. Cl. ..... 81/59.1

[58] Field of Search ..... 81/60, 61, 62, 63, 59.1

[56] References Cited

U.S. PATENT DOCUMENTS

| | | | |
|---|---|---|---|
| 1,807,134 | 5/1931 | Pfauser | 81/61 |
| 1,873,472 | 8/1932 | Pfauser | 81/61 |
| 3,204,496 | 9/1965 | Ingram | 81/59.1 |

*Primary Examiner*—James L. Jones, Jr.

*Attorney, Agent, or Firm*—Reed, Smith, Shaw & McClay

[57] ABSTRACT

A socket drive in which a handle is connected to a cylindrical head with a roller clutch internally secured therein. A drive member is maintained within the roller clutch and includes a longitudinal passageway wherein a slidable extension member is lodged. The ends of the slidable extension member are connectable to the sockets. The drive member locks with the roller clutch when rotated in one direction such that torque applied to the handle is transmitted to the socket through the roller clutch, drive member, and slidable extension. In the opposite direction, the drive member turns freely in the roller clutch so that substantially no torque is transmitted to the socket.

2 Claims, 4 Drawing Figures

SOCKET DRIVE

BACKGROUND OF THE INVENTION

1. Field of the Invention

The subject invention is directed to socket drives and, more particularly, socket drives that employ roller clutch mechanisms.

2. Description of the Prior Art

Sockets for turning nuts, bolts, and similar fasteners have found wide acceptance throughout the mechanical arts. They generally permit such fasteners to be turned more easily and quickly and generally cause less wear to the fasteners themselves as compared to other types of wrenches such as adjustable wrenches, box wrenches, and open-end wrenches.

Sockets require a compatible drive mechanism that engages the socket and affords the user a handle by which to apply torque to the socket. To permit the socket to be quickly turned in one direction, socket drives generally provide full torque in one direction and are substantially free-turning in the opposite direction.

Drives known in the prior art have employed various ratchet mechanisms wherein a set of teeth are generally fixed to the handle portion of the drive and a drive mechanism connected to the socket is provided with a number of pawls that engage the teeth. The angular direction in which the pawls engage the teeth is controlled by a selector lever. Examples of such ratchet-type socket drives are shown in U.S. Pat. Nos. 2,570,779; 2,744,432; 2,982,161; 3,044,591; 3,362,267; 3,533,315; 3,881,376; and 4,137,801.

Problems with such ratchet-type drives are primarily the result of the complex mechanical arrangement of the ratchet mechanisms. The ratchet mechanisms often permitted a high degree of play and required close tolerances that made the drives subject to failure caused by mechanical wear. Also, the ratchet mechanisms were too delicate for certain applications and were subject to failure from over-stress. In addition, the designs of the ratchet mechanisms were such that they required a certain threshold countertorque from the fastener and socket before they would ratchet in the opposite direction. When the fastener was sufficiently free to turn so that this threshold countertorque did not develop, the user generally had to supply such force with his free hand. To do this was often inconvenient and awkward and sometimes impossible.

Socket drives have been developed which sought to overcome the disadvantages of the ratchet type drives. Such drives included a type wherein a roller clutch is secured within the cylindrical head portion of a handle and the drive member is concentrically maintained within the roller clutch. The drive member included an extended portion on at least one end for engaging the socket. Examples of roller clutch-type drives are shown in U.S. Pat. Nos. 2,139,650; 3,398,612; and 4,051,935.

Such roller clutch-type drives offered many advantages over ratchet-type drives. They are generally more durable than ratchet-type drives and are able to withstand extreme torque loadings. As another example, ratchet-type drives require that the handle be rotated through at least a given angle before the handle will engage the drive member at a new angle in the torque direction. This sometimes created difficulties when there was minimal space in which the drive could be turned. In reversing the roller clutch-type wrench, there is substantially no minimum angle through which the handle must be turned before the handle will engage the drive at a new angle. As another example of the advantage of roller clutch-type drives, the counter-torque required by the ratchet mechanism of ratchet-type drives was often too great for the fastener to overcome. Thus the fastener and socket would merely rotate in the reverse direction along with the drive handle. In roller clutch-type drives, the counter-torque required is much lower so that reverse rotation of the socket and fastener seldom occurs.

However, the roller clutch-type ratchets known in the prior art shared a significant disadvantage. Namely, such roller clutch-type drives could provide torque in only one angular direction. To provide torque in both directions, extended portions were included on both sides of the drive member or the drive member was mounted such that it could be removed from the cylindrical head and remounted in inverted fashion.

Both these alternatives had disadvantages. Where extended portions were provided from both sides of the drive, the drive was too large for use in many applications. Drives of the type in which the drive member was removed from the cylindrical head and inverted were awkward, time consuming and difficult to use. Accordingly, there was a need in the prior art for a roller clutch-type socket drive that would overcome these disadvantages.

SUMMARY OF THE INVENTION

In accordance with the present invention, a socket drive includes a handle having a cylindrical head at one end thereof. A member having a passage extending therethrough is concentrically maintained within the roller clutch. A slidable extension is lodged in the passage through the drive member and is longitudinally moveable within the passage to expose opposite ends of the member for insertion into the sockets.

Preferably, the drive member is provided with at least one stop member and the slidable extension is provided with at least one projection that cooperates with the stop member to limit longitudinal movement of the extension. More preferably, the stop member is situated in the central region of a keyway located adjacent the passage and the extension is provided with two projections that extend into the keyway and are arranged on opposite sides of the stop member.

Also preferably, the slidable extension is provided with a first detent means, such as detent balls adjacent the ends thereof, and the drive member is provided with second detent means, such as detent socket, adjacent the end portions of the passage. The first detent means or detent balls are positioned so that when one detent ball is engaged with one of the detent sockets, one end of the extension extends from the passage, and when the other of such detent balls is engaged with the other of the detent sockets, the other end of the extension extends from the passage.

Other details, objects, and advantages of the invention will become apparent as the following description of a certain presently preferred embodiment thereof proceeds.

BRIEF DESCRIPTION OF THE DRAWINGS

The accompanying drawings show a presently preferred embodiment of the invention in which.

DESCRIPTION OF THE PREFERRED EMBODIMENT

Figure 1:
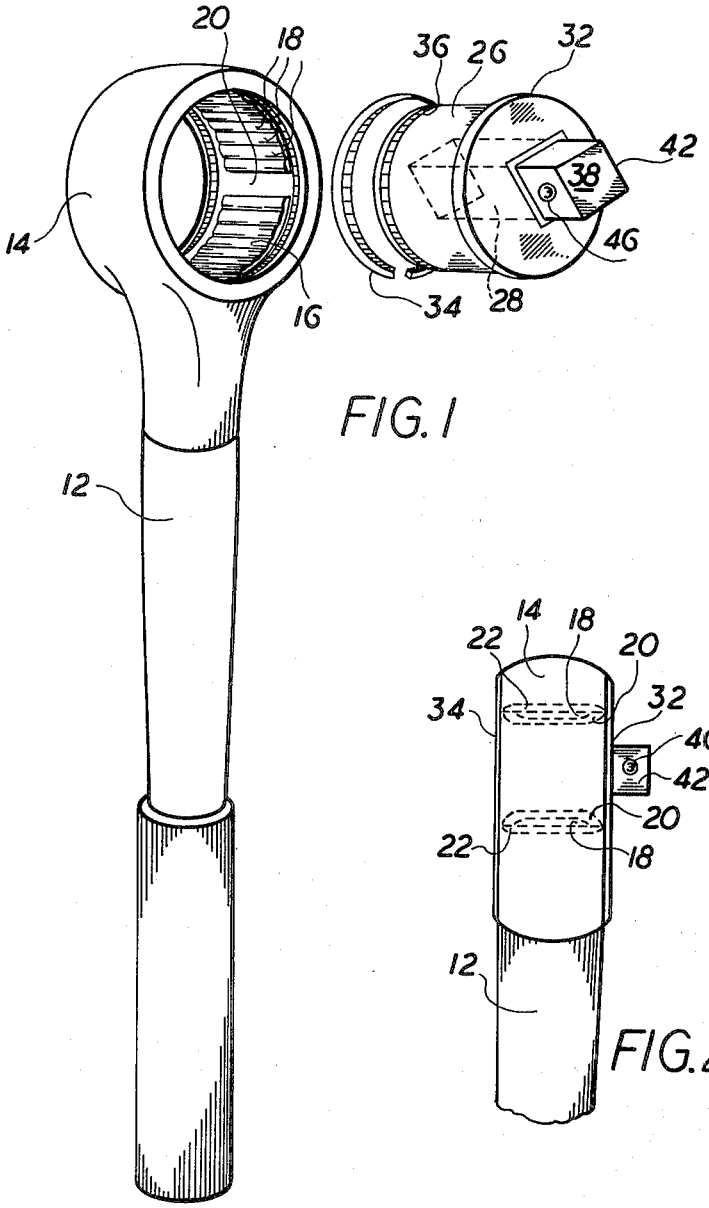
FIG. 1 is an exploded perspective view of the preferred embodiment of the socket drive herein disclosed.
Figure 2:
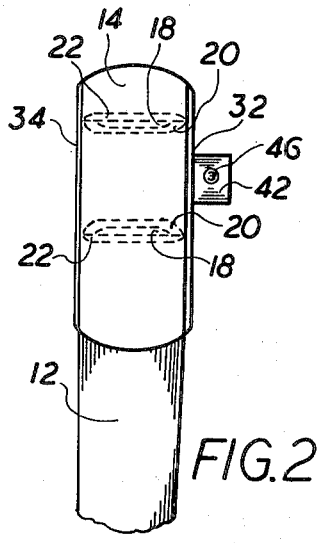
FIG. 2 is a side elevation of the socket drive of FIG. 1.

The socket drive herein disclosed obviates the problems and difficulties with roller-clutch type mechanisms of the prior art. As shown in FIGS. 1 and 2, the socket drive includes a handle 12 having a cylindrical head 14 at one end thereof.

A roller clutch 16 is secured within head 14. Roller clutch 16 includes rollers 18 that are maintained between a roller cage 20 and an outer cup 22. Outer cup 22 is provided with internal ramps (not shown) that are arranged in a saw tooth pattern circumferentially along the inner surface of cup 22. Preferably, roller clutch 16 further includes springs (not shown) that urge the rollers in a circumferential direction up the internal ramps. Suitable springs can be leaf springs although coil springs could also be used. Commercially available roller clutches include Torrington type FC manufactured by the Torrington Company of Torrington, Connecticut.

The socket drive further includes drive member 26 that fits concentrically within roller clutch 16. Drive member 26 includes a passage 28 longitudinally extending through the center thereof. The tolerance between the circumferential surface of drive member 26 and rollers 18 of roller clutch 16 is such that rollers 18 turn freely when the relative rotation between cup 22 and drive member 26 is such that the rollers tend to roll down the ramps. However, rollers 18 become locked between drive member 26 and cup 22 when the relative rotation between cup 22 and drive member 26 is such that the rollers tend to roll up the ramps. Thus, drive member 26 turns freely within roller clutch 16 in one angular direction but is locked from turning in the opposite angular direction.

As also shown in FIG. 1, drive member 26 is longitudinally maintained in roller clutch 16 by boss 32 and retainer ring 34 that snaps into annular groove 36 such that, in the assembled position, cylindrical head 14 is maintained between boss 32 and retainer ring 34 and drive member 26 is concentrically maintained within roller clutch 16.

Figure 3:
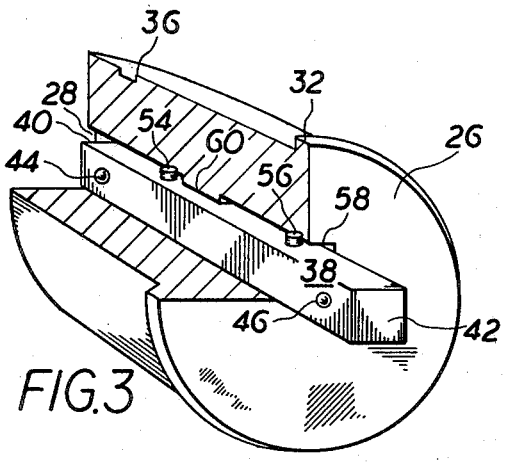
FIG. 3 is a perspective view of the drive member of the disclosed socket drive shown in FIG. 1 in partial section.
Figure 4:
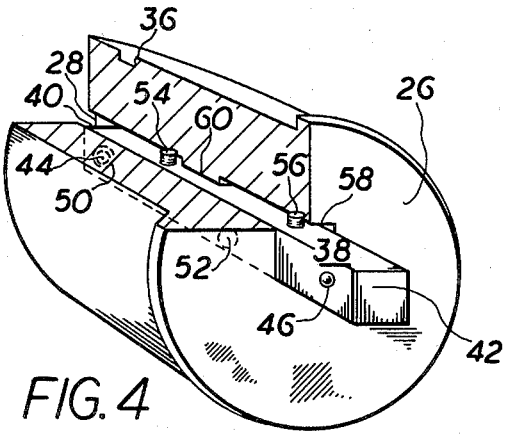
FIG. 4 is another perspective view of the drive member of the disclosed socket drive shown in FIG. 1 in partial section.

As shown more specifically in FIGS. 3 and 4, the drive of the subject invention further includes an extension member 38 having opposite ends 40 and 42 adapted for insertion into a socket. Preferably, extension member 38 has a square cross-section although cross-sections of other shapes are also suitable.

Extension member 38 is lodged in passage 28 such that it is non-rotatable within drive member 26, but longitudinally slidable in passage 28. Extension member 38 is moveable in one direction to expose end 40 and moveable in the opposite direction to expose end 42.

Extension member 38 is provided with detent means at ends 40 and 42 such as detent balls 44 and 46 for mounting the sockets on the ends. Detent balls 44 and 46 cooperate with a complementary detent means such as detent sockets 50 and 52 on drive member 26. Detent sockets 50 and 52 are located adjacent the end portion of passage 28 such that when detent ball 44 engages with detent socket 50, end 42 is exposed from passage 28 and in position to receive a socket thereon. Likewise, when detent ball 46 engages with detent socket 52 and 40 is exposed from passage 28 and in position to receive a socket thereon.

Extension member 38 is further provided with projections 54 and 56 and drive member 26 further includes a keyway 58 located adjacent passage 28 with projections 54 and 56 extending into keyway 58. A stop member 60 is located in the central region of keyway 58 between projections 54 and 56 and cooperates with projections 54 and 56 to limit longitudinal movement of extension member 38 within drive member 26. Projection 54 and 56 and stop member 60 thus cooperate to maintain extension member 38 within passage 28 within a given range of longitudinal movement.

In the operation of the preferred embodiment extension member 38 is positioned within drive member 26 such that one of ends 40 or 42 extends from passage 28 as determined by the angular direction in which torque is to be applied to the fastener. A socket is then fitted into the appropriate end 40 or 42. When When handle 12 is turned in the direction for applying torque, rollers 18 in roller clutch 16 roll up the internal ramps in outer cup 22 until they lock with drive member 26. Torque applied to handle 12 is then transmitted through roller clutch 16 drive member 26 and extension member 38 to the socket.

When handle 12 is turned in the opposite direction, rollers 18 tend to roll down the internal ramps in outer cup 22 such that drive member 26 is substantially free to turn inside roller clutch 16 and substantially no torque is transmitted to the socket. The torque applied to the socket in such opposite direction is generally limited to the rolling friction of rollers 18 and is substantially below the threshold countertorque required for ratcheting by ratchet-type drives known in the prior art.

When handle 12 is again rotated in the first direction, rollers 18 lock into drive member 26 when they have traveled sufficiently up the internal ramps of outer cup 22. The angular distance handle 12 must be turned before rollers 18 lock onto drive member 26 is sometimes referred to as backlash. Generally, this angular distance is small. Preferably, however, the backlash is further reduced by the springs that generally urge rollers 18 up their respective ramps such that the rollers are maintained on the internal ramps at a position adjacent below where they engage drive member 26. Accordingly, the springs provide that rollers 18 move only a short distance up their respective ramps before locking with drive member 26.

According to the preferred embodiment, when torque is to be applied in the opposite direction, extension member 38 is adjusted by sliding it longitudinally through passage 28 until the opposite one of ends 40 or 42 extends from passage 28 and one of detent balls 44 or 46 is in registry with the respective one of detent sockets 50 or 52. The socket is then placed on the end of 40 or 42.

Thus, the preferred embodiment of the subject invention provides a reversible roller clutch-type drive having a socket extension on only one side of the drive, but does not require disassembly and reversal of the drive member for its normal operation. Other embodiments of the subject invention will be apparent to those skilled in the art. For example, the roller clutch can further include roller bearings on opposite sides of the clutch to further reduce the rolling friction of drive member 26.

While a presently preferred embodiment of the invention has been shown and described, it is to be understood that the invention is not limited thereto but can be otherwise variously embodied within the scope of the following claims.

I claim:

1. A socket drive comprising:

a handle having a cylindrical head at one end thereof;

a roller clutch that is secured within the cylindrical head;

a drive member concentrically maintained within the roller clutch and having a passage extending therethrough, said drive member and roller clutch being locked from movement in one angular direction and being substantially free turning in the opposite angular direction;

an extension member that is slideably lodged in the passage of said drive member, said extension being longitudinally moveable within said passage in one direction to expose a first end of the extension member for insertion into the socket and longitudinally moveable in the opposite direction to expose a second end of the extension member for insertion into the socket;

at least one detent ball adjacent each end of the slideable extension member and at least one detent socket adjacent each end portion of the passage of said drive member, said detent balls and detent sockets being positioned so that when one of the detent balls is in registry with one of said detent sockets one end of the extension member extends from the passage, and when a second detent ball is in registry with a second detent socket, the opposite end of the extension member extends from the passage; and a keyway adjacent the passage of said drive member, said keyway having a stop member in the central region thereof, and first and second projections adjacent the slideable extension member, said first and second projections arranged to cooperate with said stop member to limit the longitudinal movement of the extension member in said passage.

2. The socket drive of claim 1 wherein said detent balls and sockets also maintain the socket on the end of said extension member.

* * * * *